United States Patent [19]

Gross

[11] Patent Number: 4,476,636

[45] Date of Patent: Oct. 16, 1984

[54] BOUNDARY AIR LAYER MODIFICATION STRUCTURE FOR HEAT TRANSFER ROLL

[76] Inventor: Frank R. Gross, 3926 Woodthrush Rd., Akron, Ohio 44313

[21] Appl. No.: 378,478

[22] Filed: May 14, 1982

Related U.S. Application Data

[63] Continuation-in-part of Ser. No. 200,765, Oct. 27, 1980, abandoned.

[51] Int. Cl.[3] ..... F26B 13/08

[52] U.S. Cl. ..... 34/114; 34/120; 34/122; 34/152

[58] Field of Search ..... 34/114, 116, 117, 120, 34/122, 123, 152

[56] References Cited

U.S. PATENT DOCUMENTS

| | | | |
|---|---|---|---|
| 638,993 | 12/1899 | Schrader et al. | 34/113 |
| 3,505,701 | 4/1970 | Keil | 15/102 |
| 4,202,113 | 5/1980 | Kankaanpaa | 34/116 |
| 4,263,724 | 4/1981 | Vits | 34/62 |

*Primary Examiner*—Larry I. Schwartz

[57] ABSTRACT

The invention relates to a simple mechanical system to effect removal, reduction or change in composition of boundary layered atmosphere associated with web passage around a heat transfer roll. In effect, the purpose of the invention is to eliminate the layer of air between the web and the heat transfer roll, or to eliminate as much air as possible so that better and more intimate contact is achieved between the web and the heat transfer roll, or to change the pressure and composition of the atmosphere, thus assuring higher efficiency of heat transfer from the roll to the web. The mechanical structure can involve a squeeze roll positioned between the heat transfer roll, squeezing the boundary layer of air attached to the web out prior to web contact to the heat transfer roll. In addition, the squeeze roll could utilize some type of vacuum associated with it. The invention further contemplates reducing the temperature of the boundary layer of air by cooling it and by utilizing stationary boundary layer removal bars and/or squeeze rolls. A squeeze roll is preferably of rubber or plastic with a softer surface so that it makes intimate contact with the heat transfer roll and is driven by contact therewith.

13 Claims, 10 Drawing Figures

BOUNDARY AIR LAYER MODIFICATION STRUCTURE FOR HEAT TRANSFER ROLL

This application is a continuation-in-part of Ser. No. 200,765 filed Oct. 27, 1980, now abandoned.

TECHNICAL FIELD

This invention is in the technical field of heat transfer rolls, but could be used in any situation where it is desirable to remove an air boundary layer from a web or surface.

BACKGROUND ART

The below-listed prior art patents are noted as being pertinent with respect to the general problem, but most of which employ a vacuum system on the driving or rotating roll: U.S. Pat. Nos. 2,679,572; 2,826,827; 3,097,933; 3,118,743; 3,122,295; 3,151,796; 3,258,184; 3,286,895; 3,327,916; 3,366,298; 3,405,855; 3,420,424; 3,465,320; 3,561,133; 3,688,336; 3,782,003; and 3,854,222.

In addition, the following references are listed as being pertinent in the general performance of heat transfer rolls and particularly chill-rolls important to "ink setting" published in (1) "An Investigation of Self-Acting Bearings," published in the Journal of Basic Engineering, December 1965, pages 837 through 846; (2) "Fluid Effects Associated with Web Handing" by Kenneth L. Knox and Thomas L. Sweeney, published at Ohio State College Ind. Eng. Chem. Process Des. Development, Volume 10, No. 21971, page 201; and "Graphic Arts Monthly"—June 1980, pages 76 through 82.

In foil bearings, the air layer between the roll and web is desirable because the web then floats over the rolls with a small amount of friction between the rotating or stationary roll (bearing) and the web. However, in heat transfer rolls, this air layer is undesirable because of resistance of the insulating qualities of the air layer trapped between the web and heat transfer roll surface, because it reduces addition or removal of heat. Its effect should be reduced if possible.

The above-referenced published literature indicates that an air layer forms under the web at the nip of the roll where the web touches the roll surface or, in other words, where the boundary layers, which are attached to the heat transfer roll surface and to the web come together and meet. This thickness $h_o$ of the air layer trapped at the nip of the web and roll can be calculated. It is less than the sum of each individual boundary layer meeting at the nip. This is expressed by the following formula $$h_o = 0.65R(6\mu u)/\pi)^{\frac{2}{3}}$$

for a non-rotating roll.

If the roll rotates with a peripheral velocity equal to and in the same direction as the web, the factor 6 in the above equation is replaced by a factor of 12. In all other equations for $h_o$ listed in reference 1, the factor $\mu$ appears also.

$\mu$ = viscosity of entrapped air u = film speed (Ref. 1)

$\pi$ = tension of web

For dimensions of the parameters in the above equation, see Reference 1.

Tests shown on page 841 of Ref. 1 show a smaller thickness $h_o$ than calculated as above.

It is generally concluded, backed up by calculations and tests, that the air layer at the nip is much smaller than the boundary layers carried along by roll and web meeting at the nip.

Also, the boundary layer at the exit quickly establishes itself after the web leaves the roll and the web may also oscillate (Ref. 1 FIG. 15).

Boundary layer thickness, Ref. 2, page 202, equation (4) gives the boundary layer thickness $$\delta = 6.37(\mu X/SV)^{\frac{1}{2}}$$

where X is the distance from the start of the boundary layer that develops on a moving, continuous flat film in a stagnant infinite fluid $\delta$ = boundary layer thickness S = fluid density V = web velocity (for dimensions, see Ref. 2).

Factors such as machine vibrations, film flutter, gravity, centrifugal force acting on the web where it changes direction at the nip and gauge variations have been neglected (page 205 of Ref. 2).

Looking particularly at the use of a chill roll in an offset print operation where the web is heated, the boundary layer attached to a 300° F. web may be higher than 300° F. because it may come out of a 500° F. air dryer. The boundary layer attached to the first chill roll, after the web leaves the first chill roll, may also be higher than room temperature. It's temperature will be between that of the chill roll surface and that of the web). When these two boundary layers meet at the nip of the roll, the temperature of the air layer at the nip will be much higher than that of the surrounding air.

The general purpose of this invention then is to reduce the effect of the air layer at the nip of the roll. Since boundary layers in general and air layer at the nip both have the viscosity $\mu$ in the equation with an exponent of $\frac{2}{3}$ and $\frac{1}{2}$, this effect can be reduced by reducing the viscosity $\mu$ or by changing other factors affecting $\mu$.

Chemical Engineers Handbook Perry 3rd edition, page 371, FIG. 17 gives viscosity in centipoises of gases at 1 atm. For instance, lowering the temperature of the air layer at the nip from 400° F. to 80° F. lowers viscosity $\mu$ of air from 0.025 to 0.018 or to 18/25=0.72 to what it was before. Air layer at the nip and its thermal resistance should be reduced to $0.72^{\frac{2}{3}}=0.88$ or by 12 percent. Assuming a previous overall thermal resistance between the web and heat transfer roll of 0.05 to 0.08, this would now be reduced by 0.12 X (0.05 to 0.08) or by 0.006 to 0.0096. Hence, with viscosity being the most influential component in the overall heat transfer resistance of approximately 0.07, between chill roll and web improvements in overall heat transfer may be about 10 percent or more by changing or reducing viscosity.

DISCLOSURE OF INVENTION

It is thus a general purpose of the invention to achieve the air layer reduction by providing an enclosure in front of the nip which can sweep out the largest part of the boundary layers and replace it with cool air of low viscosity. Another option of the invention is to achieve a reduction in the thickness of the boundary layer by a mechanical rubber-covered "squeeze" roller riding on the heat transfer roll, squeezing off the boundary layer attached to the heat transfer roll surface, while at the same time also touching the web approaching the nip of the heat transfer roll where it rotates against the web, being most effective by reducing the hot boundary layer thickness of the web as it enters the nip area. Friction with the web would be minimal because of the "foil bearing" effect. Means to change the contact pressure of this squeeze roll by springs, weights, air or hydraulic cylinders common in many shops is also to be included for removing more of the boundary layer attached to the chill roller as it proceeds towards the nip of the roll.

A further object of the invention is to provide a space bounded by the squeeze roller, the heat transfer roll surface and the web so that it could be purged by air blown in from one side and exiting at the other side, and also air could be entered in the middle of the space through a pipe and blown out each end without any enclosure at the sides.

A further object of the invention is to provide for cooling of the air boundary layer, with only small amounts of cooling necessary to reduce the viscosity $\mu$ factor. Vacuum would also be applied to reduce $\mu$.

A further object of the invention is that the entire structural arrangement to achieve increased efficiency is inexpensive, easy to install and extremely reliable in operation.

A further object of the invention is to provide a boundary layer with other gases than air and which have lower viscosities, such as propane, with these gases piped back to a useful gas-heating dryer and burned in the exhaust stack so that its thermal energy could thus be recovered.

A further object of the invention is that the "squeeze" roll could be riding upon and driven by the heat transfer roll, which will reduce its temperature by direct contact with this chill roll (in case of cooling), or by appropriate gearing from the heat transfer roll stand.

The aforesaid objects of the invention and other objects which will become apparent as the description proceeds are achieved by an apparatus for effecting boundary air layer modification for a heat transfer roll being structurally positioned to receive a web therearound wherein heat transfer is occasioned between the web and the roll which comprises: means mounting the heat transfer roll in rotatable journaled condition; means to pass the web around the heat transfer roll forming a nip at the point of contact of the web with the heat transfer roll; wiping means in immediately proximate adjacent relationship with the heat transfer roll as close as possible to the nip to mechanically squeeze the air boundary layer from the heat transfer roll as it approaches the nip, such means also having the web in slidable contact thereto in close proximity to the nip to mechanically wipe the boundary layer of air from the underside of the web immediately adjacent to the nip.

BRIEF DESCRIPTION OF DRAWINGS

For a better understanding of the invention, reference should be made to the accompanying drawings wherein:

FIG. 2-B is the same view as FIG. 2-A, but at a section down the length thereof showing the inlet and outlet for changes of atmosphere;

FIG. 3-A is a front elevational view of a steel-chromeplated squeeze roller with rubber or plastic at only the ends;

BEST MODE FOR CARRYING OUT THE INVENTION

While it should be understood that in accordance with the patent statutes, only the preferred embodiment or embodiments of the invention are described hereinafter, and that the preferred embodiment is in conjunction with a chill roll operating to set the ink on a high speed offset press, the invention is applicable to any heat transfer roll, whether it be for cooling or heating, and is designed to reduce the thickness and/or affect of the air layer at the nip between the web and the heat transfer roll, thus increasing the efficiency of heat transfer from the roll to the web.

Normally, the web in printing presses will have a speed of 300 to 2,000 feet per minute, with web tension of 1 to 10 pounds per inch of width and the web temperature of around 310° F. entering the nip of the cooling roll. A typical cooling roll surface temperature will be approximately 110° F. with a wraparound angle of 260° and a roll surface of 16–32 microfinish, a paper web of 40 pounds per ream, with a ream having approximately 3,000 square feet of surface. The web will normally have a specific heat of about 0.35. As indicated in the publications noted above, the equations for boundary layers, thickness, and temperatures, is dependent upon the thickness and temperature of the air sucked in at the nip of the cooling roll and its effect on the heat transfer characteristics from the cooling roll to the web.

Figure 1:
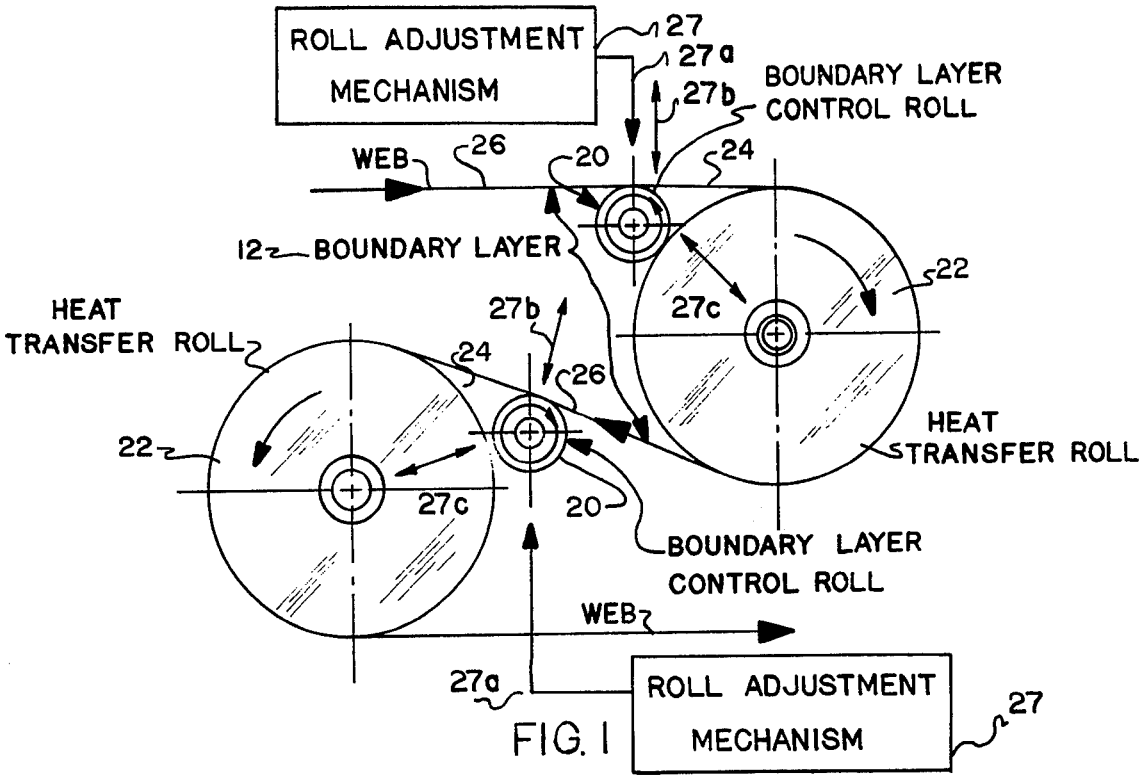
FIG. 1 is a schematic illustration of the general arrangement incorporating a pair of "squeeze" rolls with a pair of chill rollers showing the web positioning therearound.

The invention is designed to eliminate or reduce the thickness of the boundary layers and their temperature indicated generally by numeral 12 in FIG. 1, as being carried on the under surface of the web and the outer surface of the cooling roll.

The preferred technique, as indicated in the general arrangement of FIG. 1, is to provide a squeeze roll indicated generally by numeral 20 to have frictional engagement with the chill roller 22 at or as close as possible to the nip 24 between the web 26 and its contact with the chill roller 22. The squeeze roll hence squeezes off as much as possible of the boundary layers of the air carried on the surface of the chill roller 22 and the under surface of web 26 so that only a small fraction of that boundary layer thickness can reform prior to the web hitting the nip 24.

In some instances, it may be very desirable to provide some slight gap between the squeeze roll 20 and the chill roller 22 and web 26. If, for example, there was wet ink or the like on the surface of the web 26, it would be undesirable for there to be direct contact which would smear the ink. Similarly, in some instances, it may be found that a counter relative movement between the roll 20 and either the chill roller 22 or the web 26 with the slight gap (say about 0.001 to about 0.005 inches) to eliminate friction and wear (also creation of heat which may be undesirable) is better than direct frictional engagement. Hence, to this end, the invention provides for roll adjustment mechanism indicated by block 27 which is mechanically connected to the roll 20 in any suitable manner capable of one skilled in the art, as depicted by arrow 27*a*, so as to provide appropriate adjustability of roll 22 in selected directions which, for example, might be normal to the web 26 as shown by double-ended arrow 27*b*, or in a radial direction with respect to roll 22 as depicted by double-ended arrow 27*c*. Thus, by a controlled combination of these motions, the optimum positioning of the roll 20 can be achieved to provide the best boundary layer reduction and, of course, this will occur by easy adjustment by the operation within easy capability of one skilled in the art.

Thus, it should be understood that while frictional engagement of the roll 20 to the roll 22 is believed optimum, in some instances, particularly where a counter-relative movement between the two is present, a small gap is probably preferable which can be controlled by mechanism 27. Even then, there will be frictional engagement between the air boundary layers but perhaps no direct contact between the rolls.

Referring now particularly to FIGS. 2-A and 2-B, the squeeze roll 20 is illustrated as incorporating a rubber outside cover of relatively soft rubber or plastic identified by numeral 21 which is designed to make contact with and be rotated at the same speed as the chill roll 22. Note the inner and outer shells 22*a* and 22*b* of the chill roll through which the heat transfer fluid is passed in a conventional manner.

In order to attempt to seal off the space which is effectively triangular when looked at in end elevation between the squeeze roll 21, the chill roll 22, and the web 26, the invention contemplates the use of essentially triangular-shaped enclosure member 25, as best seen in FIG. 2-A, it being understood that there is one of these enclosure members at each lateral end of the respective rollers. A very small clearance 27 is provided between the chill roll 22 and the enclosure member 25 so that there is not contact and damage to the chill roll. A similar small gap 27*a* is provided between the squeeze roll 20 and the enclosure member 25, but the web 26 just rides on the top surface of the enclosure member 25. Thus, with the boundary layer being squeezed off the surfaces of the chill roll and the web, and with enclosure members 25 on each end tending to provide a seal, the likelihood of new boundary layers being formed is greatly reduced.

The invention also contemplates that an inlet and outlet might be provided through the enclosure member 25 as best indicated by numeral 29 in FIG. 2-B which can be utilized to draw a vacuum in the enclosed area, or possibly inject reduced temperature air, or some other medium which would have a lower $\mu$ factor as explained above, thus increasing heat transfer characteristics between the chill roll 22 and the web 26. The inlet and outlet 29 might tie into a long extended hollow tube that would cover the entire length between both enclosure members 25, thus allowing a vacuum to be drawn along the whole length of the enclosed area, and the like.

Figure 3:
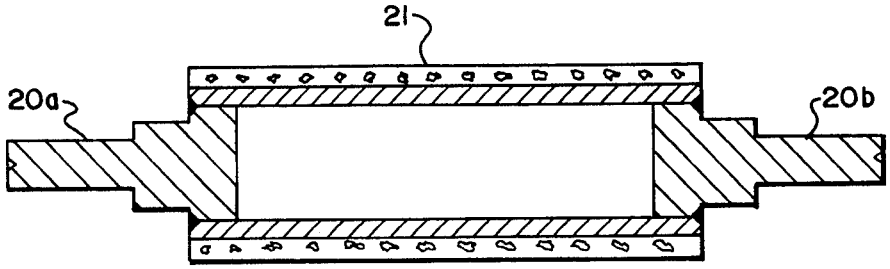
FIG. 3 is a front elevational view of the squeeze roll itself having a full resilient rubber or plastic-coated cover thereover.
Figure 3A:
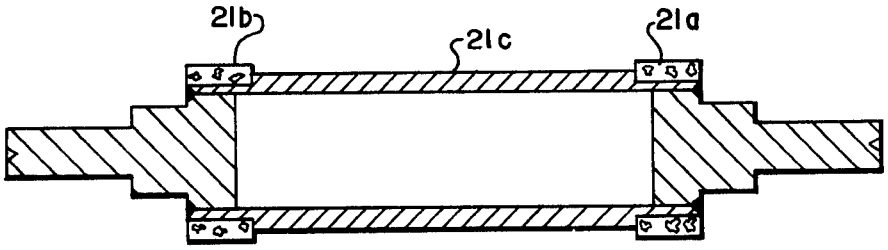

Looking now to FIG. 3, the squeeze roller incorporates a simple roller having journals 20*a* and 20*b* on opposite ends to allow it to be rotatingly mounted, and carries a relatively soft rubber or plastic outer surface 21 which allows it to be in frictional driving contact with the chill roller 22, simply by gravity drop thereagainst, but to attain an intimate squeezed relationship, thus eliminating and squeezing off the boundary layer of air from the chill roller. Additional means to create pressure by the chill roller would be by springs, air cylinders, counterweights, etc. FIG. 1 illustrates the fact that the web 26 passes slightly up and over the top surface of the squeeze roll 20, thus ensuring an intimate contact therewith and again squeezing the boundary layer of air off prior to the web hitting the nip 24.

FIG. 3-A illustrates a slightly modified squeeze roller which has the rubber or plastic cover only on end portions 21*a* and 21*b* with the basic portion of the roll being a steel or chromeplated, very smooth configuration so that frictional engagement is between the end rubber portions 21*a* and 21*b*, but very close tolerance contact is achieved with the steel chromeplated surface 21*c*. In this embodiment, the web 26 will tend to slide more easily over the chrome-plated surface 21*c* than with the full rubber covering area 21 of FIG. 2.

Figure 4:
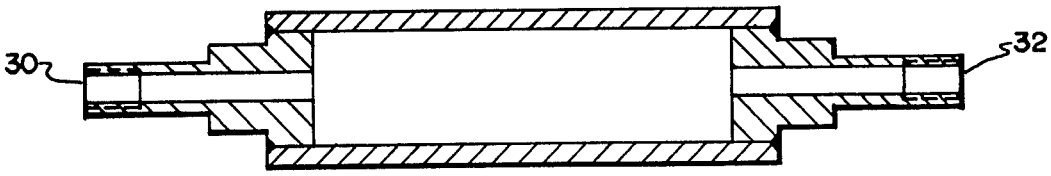
FIG. 4 is a squeeze roll which incorporates heat transfer characteristics.

FIG. 4 illustrates a squeeze roller with heat transfer characteristics, namely one having inlet port 30 and outlet port 32 which might be utilized where there would be a tendency for the squeeze roller to overheat, and this would be a form to allow it to be cooled. While the surface of the squeeze roll in FIG. 4 is illustrated as solid steel or chromeplated, it naturally could be of the form shown in either FIG. 3 or 3-A. Naturally, the roll shown in FIG. 4 might also be the same type of roll as the chill roll itself with the heat transfer area being only a small portion of concentric shells, rather than a passage through the entire interior portion thereof.

The invention further contemplates that the squeeze roll shown in FIGS. 3–4 could incorporate a spiral groove from each end toward the middle to assist in centering the web, removal of the boundary layer in the squeeze roller arrangement, as well as to assist in the vacuum removal of the boundary layer or a pressure application to reduce boundary layer temperature.

Figure 5:
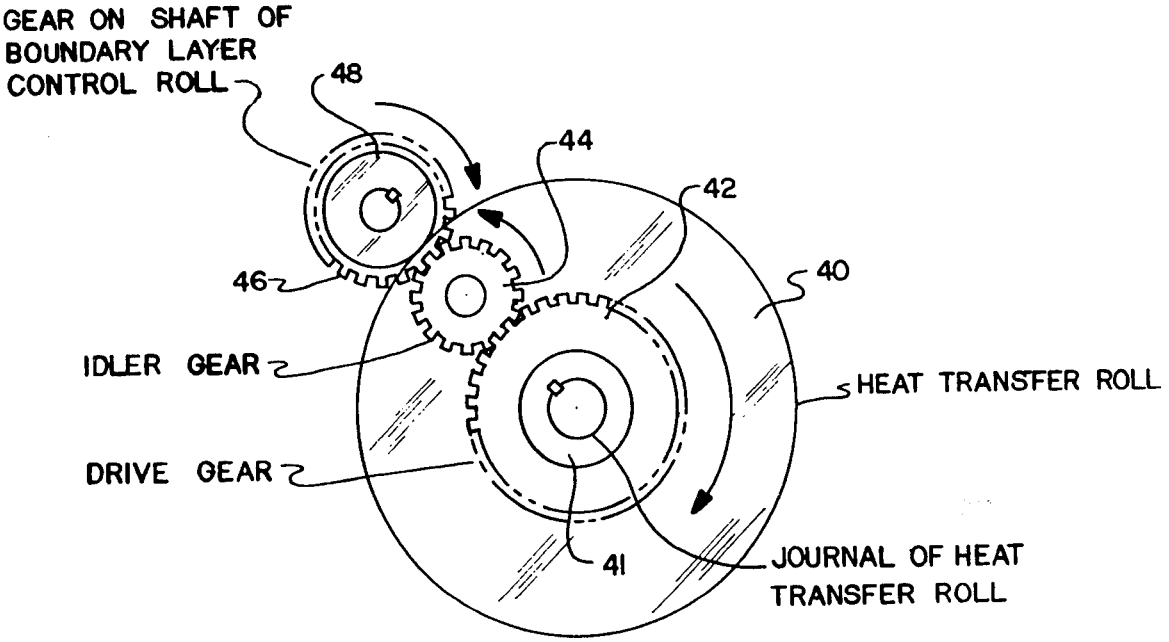
FIG. 5 is an end elevational schematic showing a gear drive arrangement for the squeeze roll.

FIG. 5 illustrates a modified embodiment of the invention which incorporates a heat transfer roll 40 having a drive gear 42 connected to the journal 41 of heat transfer roll 40, which drives an idler gear 44 which in turn drives a gear 46 that is connected to the shaft of the squeeze roll 48. In this way, a positive driving action between the heat transfer roll 40 and the squeeze roll 48 is achieved in that in some instances it may be desirable over the friction connection relationship and perhaps would be more appropriate when using the squeeze roll having heat transfer characteristics such as that shown in FIG. 4.

Figure 6A:
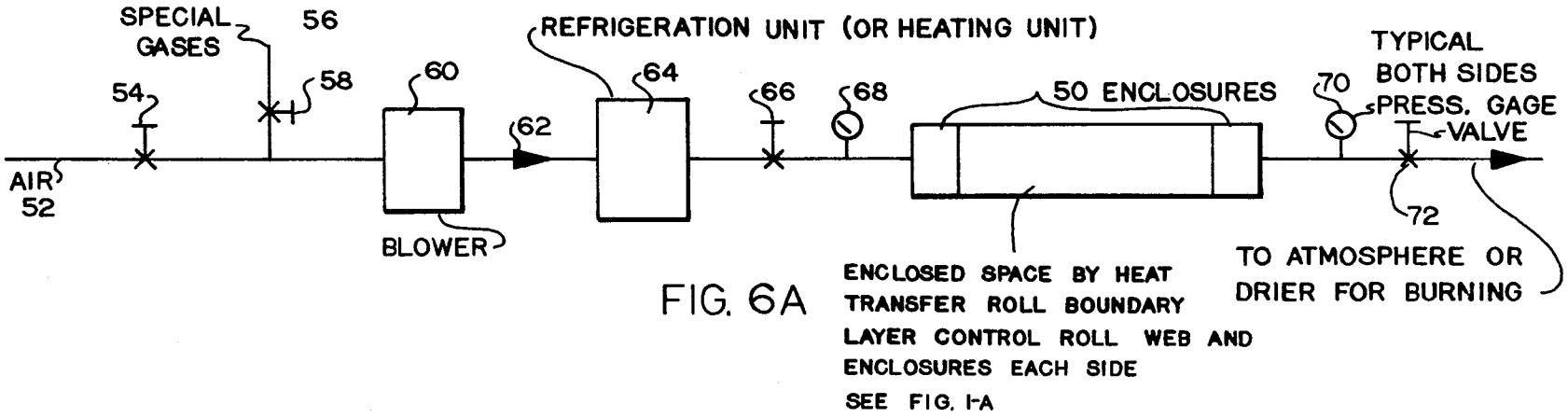
FIGS. 6-A and 6-B are schematic illustrations of a modified embodiment wherein other gases can be injected into the space between the squeeze roll, chill roll, and web or vacuum applied to this space.
Figure 6B:
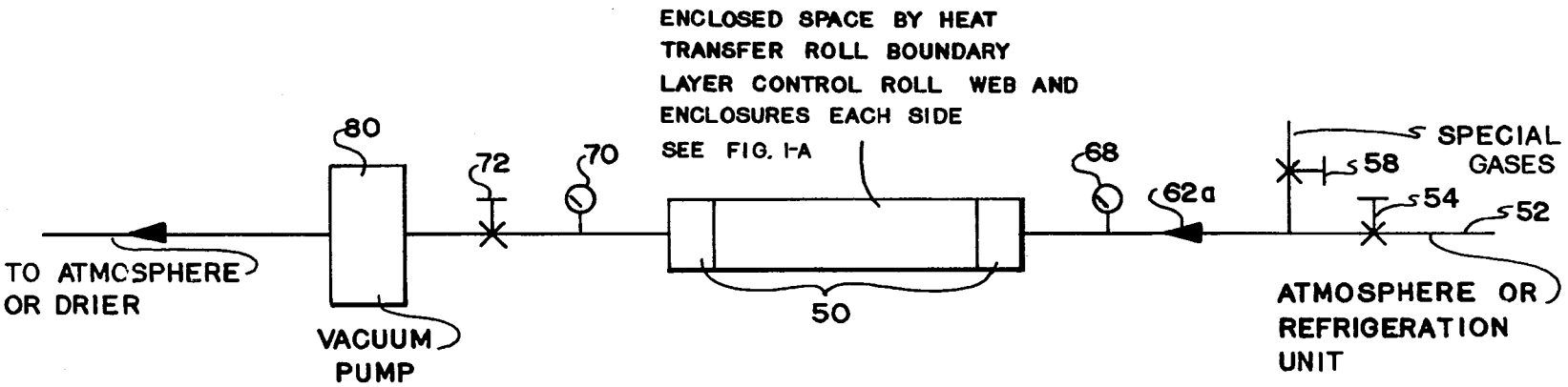

FIG. 6-A is a schematic illustration showing how either special gases or refrigeration can be provided as an input through the enclosures into the confined area defined between the squeeze roll, the web, and the heat transfer roll. Looking particularly at FIG. 6-A, the enclosures are indicated generally by numeral 50, which are of course on opposite ends of the chill roll and idler and squeeze roll combination. Air 52 is provided on the left side through a valve 54 with special gases 56 being applied if desired through another valve 58. A blower 60 directs the input mixture in the direction of the arrow 62 through a refrigeration and/or heating unit 64, a control valve 66, a pressure gauge 68, and then into the enclosed area. An outlet pressure gauge 70 operating in conjunction with an outlet valve 72 completes the schematic cycle with the exhaust then being to atmosphere or a dryer for burning if a special flammable gas is provided.

The embodiment of FIG. 6-B again incorporates the enclosures 50, but incorporates a vacuum pump 80 operating in conjunction with the same valving arrangement as in FIG. 6-A, but eliminating the blower 60 and the refrigeration unit 64. In this instance, the direction of flow is in the direction of arrow 62*a*. Comparable numbers to the same components in FIG. 6-A are incorporated.

Figure 2B:
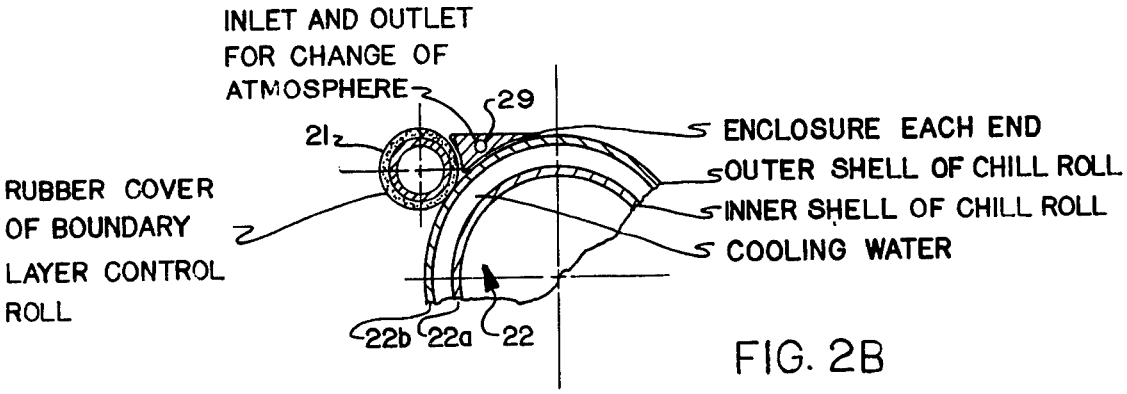
FIG. 2-A is an end elevational section of the squeeze roll and chill roll having air inlets and/or vacuum emissions, and particularly the clearance for the side closures with respect to the rolls.
Figure 2A:
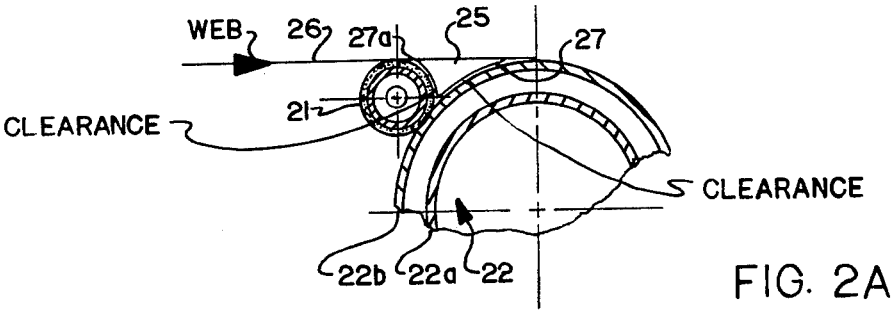
Figure 7:
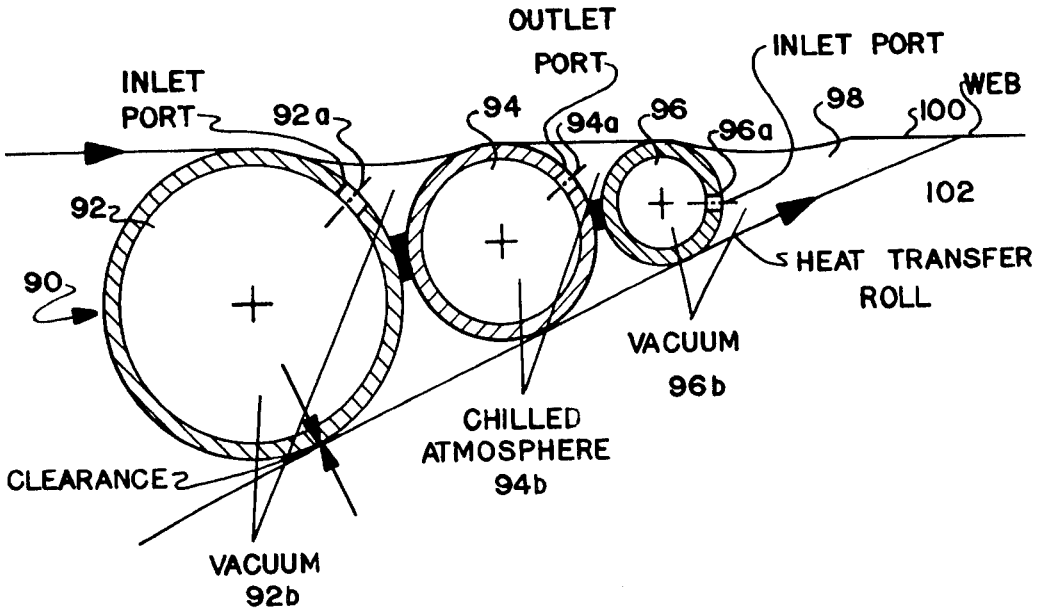
FIG. 7 is a side schematic showing a modified stationary washboard type device positioned at the nip between the web and the chill roll acting as a stationary boundary layer removal bar.

The embodiment of the invention illustrated in FIG. 7 is a stationary boundary layer removal bar illustrated generally from the numeral 90 which comprises three independent chambers 92, 94, and 96 that are positioned so as to get as far into the nip 98 between the web 100 and heat transfer roll 102 as possible. The web 100 will actually ride over top the bar 90 and very small clearance is provided between the heat transfer roll 102 and the bar 90 as is indicated. The chamber 92 incorporates an inlet port 92*a* through which a vacuum is drawn as illustrated by 92*b* so that air is exhausted from the boundary layer on the bottom surface of the web 100. The chamber 94 incorporates a chilled atmosphere input 94*b* that operates through an outlet port 94*a* to discharge a chilled atmosphere with chamber 96 again having a vacuum 96*b* to draw off all excess air remaining through port 96*a* in the area immediately adjacent the nip 98. The movement of the atmosphere is indicated by the respective arrows 104 showing how the stationary bar will effect a boundary layer removal as well as reduction in temperature of any boundary layer remaining, allowing the stationary bar arrangement to operate very effectively. Again, a suitable enclosure member could be incorporated on each end of the stationary bar in the same way as shown in FIGS. 2*a* and 2B so that the total area is basically enclosed.

It should further be understood that the invention contemplates that the wiping means might also include more than one squeeze roll, with a smaller diameter roll more nearly adjacent the nip. Further, in some instances, it might be desirable to utilize a squeeze type wiper blade made from a self-lubricating blade with a low friction coefficient which will directly contact the chill roll and the web.

Every effort has been made to illustrate and describe the invention as indicated above, but it is to be understood that the invention is not limited thereto or thereby, but that the inventive scope is defined in the appended claims.

What is claimed is:

1. Apparatus for effecting boundary air layer modification for a heat transfer roll being structurally positioned to receive a web therearound wherein heat transfer is occasioned between the web and the roll which comprises means mounting the heat transfer roll in rotatable journaled condition;

means to pass the web around the heat transfer roll forming a nip at the point of contact of the web with the heat transfer roll;

wiping means in immediately proximate adjacent relationship with the heat transfer roll as close as possible to the nip to mechanically squeeze the air boundary layer from the heat transfer roll as it approaches the nip, such means also having the web in close proximity thereto and to the nip to mechanically wipe the boundary layer of air from the underside of the web immediately adjacent to the nip, wherein the wiping means is a rotatable squeeze roll extending the full length thereof arranged in parallel relation thereto, but of small diameter and positioned immediately adjacent the nip.

2. Apparatus according to claim 1 which includes enclosure means to substantially enclose the openings between the heat transfer roll, the squeeze roll, and the web at both ends and create a confined area.

3. Apparatus according to claim 1 which includes means to effect a suction on the area defined by the heat transfer roll, the squeeze roll, and the web.

4. Apparatus according to claim 1 which includes means to change the physical characteristics of the atmosphere in the area defined by the heat transfer roll, the squeeze roll and the web with the enclosure means by adding air under pressure to reduce the overall temperature.

5. Apparatus according to claim 1 which includes means to change the physical characteristics of the atmosphere in the confined area defined by the heat transfer roll, the squeeze roll and the web with the enclosure means by reducing the $\mu$ thereof.

6. Apparatus according to claim 3, 4, or 5 which includes means for separately controlling the respective means for reducing the thickness density, temperature, thermal conductivity and viscosity of the atmosphere adjacent the nib.

7. Apparatus according to claim 1 wherein the squeeze roll incorporates an elastomeric surface which is driven by frictional contact with the heat transfer roll to effect rotation of the squeeze roll.

8. Apparatus according to claim 1 wherein the squeeze roll incorporates elastomeric material on the ends thereof effecting frictional driving contact by engagement with the heat transfer roll and being slightly oversized to leave a small space between the remaining length of the squeeze roll and the heat transfer roll.

9. Apparatus according to claim 1 which includes separate drive means to rotatably drive the squeeze roll, and where the squeeze roll is in frictional engagement with the heat transfer roll.

10. Apparatus according to claim 1 which includes means to effect controlled positional movement of the squeeze roll in parallel relation to the web and the heat transfer roll.

11. Apparatus for effecting boundary air layer modification for a heat transfer roll being structurally positioned to receive a web therearound wherein heat transfer is occasioned between the web and the roll which comprises means mounting the heat transfer roll in rotatable journaled condition;

means to pass the web around the heat transfer roll forming a nip at the point of contact of the web with the heat transfer roll;

wiping means in immediately proximate adjacent relationship with the heat transfer roll as close as possible to the nip to mechanically squeeze the air boundary layer from the heat transfer roll as it approaches the nip, such means also in close proximity to the web at the nip to mechanically wipe the boundary layer of air from the underside of the web immediately adjacent to the nip, wherein wiping means is a fixed hollow bar mounted immediately adjacent the heat transfer roll and the nip, and includes means to sequentially apply a vacuum, an air pressure to effect a temperature reduction, and a vacuum in the area immediately adjacent the nip.

12. Apparatus according to claim 11 where the hollow bar includes three separate chambers of progressively larger size away from the nip, and which further includes enclosure means to close the laterally opened spaces between and define a confined area bounded by the heat transfer roll, the wiping means and the web, and wherein each chamber is in communication with the confined area.

13. Apparatus according to claim 11 where the web is in sliding engagement with the hollow bar.

* * * * *

UNITED STATES PATENT OFFICE
CERTIFICATE OF CORRECTION

Patent No. 4,476,636 Dated October 16, 1984

Inventor(s) Frank R. Gross

It is certified that error appears in the above-identified patent and that said Letters Patent are hereby corrected as shown below:

Column 1, line 55, delete "π" to --T--;
line 64, delete "π" to --T--.

Column 2, line 12, delete "SV" and substitute therefor --ς V-- line 17, delete "S" and substitute therefor --ς--.

Column 4, line 68, delete the words "direct" and substitute therefor --indirect--.

Signed and Sealed this

Sixth Day of August 1985

[SEAL]

*Attest:*

DONALD J. QUIGG

*Attesting Officer* *Acting Commissioner of Patents and Trademarks*